United States Patent [19]

Marz

[11] 4,047,376

[45] Sept. 13, 1977

[54] CLOCK MECHANISM

[75] Inventor: Frank Hubert Marz, Delavan, Wis.

[73] Assignee: Bunker Ramo Corporation, Oak Brook, Ill.

[21] Appl. No.: 627,375

[22] Filed: Oct. 30, 1975

[51] Int. Cl.[2] ..... G04C 3/00; H01H 51/22; H01F 7/08

[52] U.S. Cl. ..... 58/23 D; 335/81; 335/229

[58] Field of Search ..... 58/23 D, 23 R, 125 C; 335/81, 229

[56] References Cited

U.S. PATENT DOCUMENTS

| | | | |
|---|---|---|---|
| 3,140,431 | 7/1964 | Schalkwijk | 335/272 |
| 3,528,239 | 9/1970 | Ganter et al. | 58/28 R |
| 3,748,846 | 7/1973 | Kikuchi | 58/26 R |
| 3,766,728 | 10/1973 | Nagy | 58/38 |
| 3,857,235 | 12/1974 | Wobler | 58/23 D |
| 3,902,310 | 9/1975 | Kreidler | 58/23 D |

FOREIGN PATENT DOCUMENTS

| | | | |
|---|---|---|---|
| 1,473,198 | 3/1967 | France | 58/23 D |
| 1,548,077 | 11/1969 | Germany | 58/23 D |
| 984,496 | 2/1965 | United Kingdom | 58/23 D |

*Primary Examiner*—E. S. Jackmon
*Attorney, Agent, or Firm*—F. M. Arbuckle; R. P. Niro

[57] ABSTRACT

An electrical clock is provided in which pulses of a 10% duty cycle are repeatedly applied at a one second rate to a solenoid which attracts an armature attached to a reciprocating ratchet once every second, the reciprocating ratchet being returned to a neutral position between each pulse. The reciprocating ratchet drives a toothed wheel which is located on a main axis of the clock frame view suitable pawls. The second hand of the clock is directly coupled by a second hand shaft to the toothed wheel. The toothed wheel, by means of a pinion, drives an intermediate gear which is located outbound from the main axis. The intermediate gear drives a minute gear, the minute gear being mounted on a minute tube concentric with the second hand shaft. The minute hand is directly affixed to the minute hand tube. The minute gear, by means of a pinion, drives an outbound motion gear, the motion gear in turn driving an hour gear coupled to an hour tube whose axis is concentric with the second shaft and the minute tube. The hour hand is affixed directly to the hour tube. Various other embodiments of the electrical clock mechanisms of the subject invention are described in more detail herein.

24 Claims, 18 Drawing Figures

CLOCK MECHANISM

FIELD OF THE INVENTION

This invention relates to clocks, in particular, to automobile clocks which are electrically driven by timed pulses. Such a clock has a conventional analog dial face and concentric hour, minute and second hands. Accordingly, it is a general object of this invention to provide new and improved clocks of such character.

DESCRIPTION OF THE PRIOR ART

Various prior art clock mechanisms utilize a quartz analog battery clock movement. A quartz crystal is used, as is well known, because of its constant frequency characteristics. The frequency of a quartz crystal can be generated, by known techniques, by a battery powered source to provide a high frequency output. The high frequency output can be divided down electronically to provide a low frequency output for driving a clock. One clock movement of the prior art embodies a 180° stepping motor which is geared down through an intermediate wheel and pinion before driving a second shaft gear, such device being driven by pulsations from a circuit board by dividing down the quartz crystal frequency. Another clock of the prior art utilizes a coil bobbin which drives an intermediate lever which, in turn, drives a second shaft ratchet wheel.

In general, electrically driven clocks including those meant for automobile operation are not new, many patents having been issued in that field as can be seen from an inspection of class 58, subclass 23. However, it is a continued endeavor to seek better automobile clocks which are more reliable and less expensive.

Automobile clocks encounter problems not normally found in the home. An automobile clock is subject to vibration as would be encountered not just in normal driving, but in driving over bumpy roads, that is, due to both normal and abnormal operation of the automobile. An automobile is also subject to severe shocks, such as encountered, for example, in various types of accidents, both minor or major. Another desired characteristic of an automobile clock is a low volume of space, since space requirement is normally at a premium in an automobile.

Automobile clocks are also subject to other problems normally associated with an automobile, namely, being susceptible to extreme changes of temperature and humidity. An automobile may be used in such extreme conditions, as driving through a hot desert, or going through a cold snowstorm or through frigid climes such as would be encountered near the polar regions.

The engine of an automobile acts to drive not only the automobile, per se, but, via a generator, to charge a battery, and, hence, provides electric power in association therewith. The electric power can be used to operate various accessories in an automobile, such as headlights, radio, and the automobile clock. It is desired that an automobile clock utilize as little power as possible due to the fact that it is electrically powered even when the automobile is not in operation, such as when the car is being garaged, or otherwise unused in the outdoors where it is subject to extreme heat or extreme cold. It is thus desired that the automobile clock be able to be operated via the automobile battery during periods of extreme temperature changes and during periods of not just hours or days, but weeks or months without any significant drain on the battery so as to cause the battery to be discharged due to the power consumed by the automobile clock.

Another requirement in an automobile clock is that it be comparatively silent, since a clock is physically located relatively close to the driver of the car or its front seat passenger and is located, normally, in the instrument panel of the automobile. Due to its physical location, sound-deadening material cannot conveniently be placed between the clock mechanism and the passenger area.

SUMMARY OF THE INVENTION

Thus, it is an object of this invention to provide a new and improved electric clock having high reliability, electronic accuracy and cost competitiveness with conventional electric clocks, while retaining beauty and flexibility of appearance afforded by conventional analog dial faces and concentric hour, minute, and second hands.

Another object of this invention is to provide a new and improved clock mechanism which requires a minimum amount of power for driving a clock.

Yet another object of this invention is to provide a new and improved clock mechanism having a minimum amount of gears associated therewith.

Still another object of this invention is to provide a new and improved clock mechanism which has a toothed second wheel, a minute gear and an hour gear, all located with their respective pinions concentric about the same axis, while utilizing a single intermediate gear between the second wheel pinion and the minute gear, and a motion gear located between the minute pinion and the hour gear.

Yet another object of the invention is to provide a novel mechanism having a solenoid and an associated pole piece affixed in such a manner that the solenoid attracts an armature of a ratchet wheel so that the armature does not physically contact either the solenoid or the pole piece.

Still another object of this invention is to provide a new and improved automobile clock which can operate efficiently in wide ranges of frequencies of vibration normally associated with the automobiles.

Yet another object of the invention is to provide a new and improved automobile clock mechanism which can operate in conditions of extreme temperature changes.

Still yet another object of this invention is to provide a new and improved automobile clock which utilizes few components.

One embodiment of the invention is directed to an electrical automobile clock which includes an analog dial face, normally viewable at one surface of a face plate within a housing and having an opening therethrough, including hour, minute and second hands which rotate about a common concentric axis, and pulsing means for converting direct current to a series of electrical pulses having a repetition rate such as, for example, every second. In accordance therewith, an hour shaft is connected to the central axis of an hour gear via the opening in the face plate to the hour hand. A minute shaft connects the common concentric axis of a minute gear and pinion concentrically with respect to the hour shaft through the opening in the face plate to the minute hand. A second shaft connects the common concentric axis of a toothed second wheel and its pinion concentrically with respect to the hour shaft and minute shaft through the opening in the face plate to the second hand, so that the central axis of the hour gear, the common concentric axis of the minute gear and pinion, and the common concentric axis of the second wheel pinion are a single common axis. Further, a motion gear shaft connects a motion gear and pinion to the housing to be rotatable therewithin so that the motion gear shaft is rotatable at about an axis parallel to and located outbound from the single axis. Also, an intermediate gear shaft connects an intermediate gear and pinion to the housing to be rotatable therewithin so that the intermediate gear shaft is rotatable about an axis which is parallel to and located outbound from the single axis. A ratchet wheel which includes the toothed second wheel, a reciprocating lever having an armature coupled thereto, a pawl for communicating motion to the second wheel, and a pawl for preventing back motion of the wheel. A solenoid, coupled to the pulsing means for receiving electrical pulses therefrom, when energized, attracts the armature. Thus, all the gears in the clock, except for the intermediate gear and the motion gear and their associated pinions, are aligned along the single common axis. In accordance with certain features of the invention, the hour shaft and minute shaft can be tubular, with the minute shaft being rotatable within the hour shaft, and the second shaft being rotatable within the minute shaft. In accordance with another feature of the invention, a back plate within the housing is oriented parallel to the face plate distal to the hour, minute and second hands so that the space between the face plate and back plate can be termed a gear area. The hour gear, motion gear and motion gear pinion are located in the gear area. The motion gear shaft is coupled to the back plate so as to be axially supported thereby while permitting rotation of motion gear shaft about its axis. The minute gear and the minute gear pinion are located in the gear area. The intermediate gear pinion is located in the gear area, but the intermediate gear is located in an area outside of the gear area separated therefrom by the back plate. The intermediate gear shaft is connected to the axis of the intermediate gear at the outside area and is connected to the axis of the intermediate gear pinion at the gear area, the intermediate gear shaft being adapted to freely rotate about its axis within the back plate. The second wheel pinion, the ratchet wheel, and the solenoid are located in the outside area.

In accordance with another embodiment of the invention, a combination includes an armature of low remanent, high permeable material adapted to be normally at rest at first position and adapted to be electormagnetically attracted to a second position. Means are effective when the armature is at the second position, in the absence of electromagnetic attraction, for causing the armature to return to the first position. Solenoid means, having a core therewithin, has a coil adapted to be coupled to receive an electrical signal. Pole piece means, connected to both ends of the core, are so formed that when the core is energized, a magnetic field is produced therebetween. Both pole pieces are oriented so that the second position is located within the magnetic field. Thus, the coil is energized, the armature is magnetically attracted to, and stops at, the second position due solely to the magnetic field, without the armature physically contacting either the solenoid means, the core, either the pole piece means, or portions thereof. In accordance with certain features of the invention, the first pole piece means has a portion thereof connected to one end of the core and has a second portion thereof formed in a circular disc, the disc portion covering at least a portion of one end of the coil, and wherein the second pole piece means is affixed to the opposite end of the core and is formed in an axial direction along the exterior of the solenoid and extends past the first pole piece circular disc portion. In accordance with certain features of the invention, the portion of the second pole piece means which extends past the disc portion is bent inwardly towards the disc portion.

In accordance with still another embodiment of the invention, an electrical automobile clock mechanism can include a second shaft which connects the axis of a toothed second wheel to a second hand. A ratchet wheel includes the second wheel, a reciprocating lever, a pawl for communicating motion to the second wheel, and a pawl for preventing back motion to the wheel. An armature of low remanent, high permeable material is coupled to the reciprocatng lever and is adapted to be normally at rest at a first position and is adapted to be electromagnetically attracted to a second position. Means are effective when the armature is at the second position, in the absence of electromagnetic attraction, for causing the armature to return to the first position. Solenoid means, including a core within a coil which is adapted to recieve an electrical signal, has a first pole piece means connected to one end of the core and has a second pole piece means connected to the opposite end of the core. The first and second pole piece means are so formed so that when the coil is energized, a magnetic field is produced therebetween. Both pole piece means are so oriented so that the second position is located within the magnetic field. When the coil is energized, the armature is magnetically attracted to the second position and stops at the second position due solely to the magnetic field, without the armature physically contacting either the solenoid means, the core, either of the pole piece means, or a portion thereof. In accordance with certain features of the invention, the first pole piece means has a portion thereof connected to one end of the core, and has a second portion thereof formed in a circular disc with the disc portion covering at least a portion of one end of the core. The second pole piece means is affixed to the opposite end of the core and is formed in an axial direction along the exterior of the solenod and extends past the first pole piece circular disc portion. In accordance with other features of the invention, at least a portion of the second pulse means, which extends past the disc portion, is bent upwardly toward the disc portion.

In still yet another embodiment of the invention, the electric clock mechanism can include a housing, a second wheel having a plurality of teeth oriented about is periphery with each tooth having a face portion oriented in a generally radial direction with respect to the wheel and having an inclined ramp portion connecting the face portion of one tooth to the face portion of an adjacent tooth. A second shaft connects the axis of the wheel to a second hand. A ratchet wheel has a reciprocating lever adapted to reciprocate from one position to another. Pawl means communicate motion to the second wheel. A pawl prevents back motion of the wheel. Means are provided for reciprocatng the lever. In this specific embodiment, the improvement resides in the pawl means which includes a music wire having one end thereof affixed to the reciprocating lever and having an end portion near the opposite end thereof adapted to engage the teeth of the wheel. Support means are provided which are affixed to the lever for supporting a substantial portion of the music wire when the music wire drives a wheel in a tooth face engaging manner, and does not support the substantial portion of the music wire when the music wire retracts a tooth distance and the music wire end portion traverses the inclined ramp portion. In accordance with certain features of the invention, the support means is essentially a cylindrical mass of material affixed to the lever with one quadrant thereof removed at a substantial portion thereof away from the lever. In still yet another embodiment of the invention, the pawl means can include a flexibility music wire having one end thereof affixed to the reciprocating lever and having an end portion near the opposite end thereof adapted to engage the teeth of the wheel. Means are provided for reducing the flexibility of the wire when the wire drives the wheel in a tooth face engaging manner and for permitting full flexibility of the wire when the wire retracts a tooth distance and the music wire end portion traverses the inclined ramp portion. In accordance with still yet another embodiment of the invention, the music wire can have one end thereof affixed to the reciprocating lever, and have an end portion near the opposite end thereof adapted to engage the teeth of the wheel. Means are provided for reducing the effective length of the wire when the music wire drives the wheel in a tooth face engaging manner, and for increasing the effective length of the wire when the music wire retracts a tooth distance and the music wire end portion traverses the inclined ramp portion.

In an electrical clock mechanism including a housing; a second hand; a second hand wheel having a plurality of teeth oriented about its periphery with each tooth having a face portion oriented in a generally radial direction with respect to the wheel and having an inclined ramp portion connecting the face portion of one tooth to the face portion of an adjacent tooth; a second shaft connecting the axis of the wheel to the second hand; a ratchet wheel having the second wheel, a reciprocating lever adapted to reciprocate from one position to another, pawl means for communicating motion to the second wheel, and a pawl for preventing back motion of a wheel; and means for reciprocating the lever, an embodiment of the invention for reciprocating the lever includes the following:

A flat spring means has one end thereof affixed to the lever and has an opposite end, free of attachment, adapted to be biased against a fixed dog and slide with respect thereto. Thus, the opposite end of the spring means is unbiased and is disengaged from the dog when the lever is at the one position. A solenoid, affixed to the housing, is adapted, when energized, to attract an armature carried by the lever so that the lever is reciprocated to the other position where the spring means opposite end engages the dog and is biased thereby.

In an electrical automobile clock having a housing and a face plate therewithin, the face plate having an opening therein from the one surface to an opposite surface thereof; hour, minute and second hands which rotate about a common concentric axis; and pulsing means for converting direct current to a series of electrical pulses having a repetition rate which can equal one second, an embodiment of the invention can include an hour shaft connecting the central axis of an hour gear via the opening in the face plate to the hour hand. A minute shaft connects the common concentric axis of a minute gear and pinion concentrically with respect to the hour shaft through the opening in the face plate to the minute shaft. A second shaft connects the common concentric axis of a toothed second wheel and a second wheel pinion concentrically with respect to the hour shaft and the minute shaft, through the opening in the face plate to the second hand, so that the central axis of the hour gear, the common concentric axis of the minute gear and pinion, and the common concentric axis of the second gear and pinion are a single common axis. A motion gear is in meshing engagement with the minute gear pinion, and a motion gear pinion is axially affixed to the motion gear with the motion gear pinion in meshing engagement with the hour gear, the motion gear and the motion gear pinion having a common concenntric axis. A motion gear shaft connects the motion gear pinion to the housing so as to be rotatable therewithin so that the motion gear shaft is rotatable about an axis which is parallel to and located outbound from the single axis. An intermediate gear is in a meshing engagement with the second wheel pinion. An intermediate gear pinion is axially affixed to the intermediate gear with the intermediate gear pinion in meshing engagement with the minute gear. The intermediate gear and the intermediate gear pinion have a common concentric axis. An intermediate gear shaft connects the intermediate gear and pinion to the housing to be rotatable therewithin so that the intermediate gear shaft is rotatable about an axis which is parallel to and located outbound from the single axis. A ratchet wheel includes the second wheel, a reciprocating lever which has an armature coupled thereto, pawl means for communicating motion to the second wheel, and pawl means for preventing back motion of the wheel. A solenoid is coupled to the pulsing means for receiving electrical pulses therefrom and, when energized by one of the pulses, for attracting the armature. Thus all the gears in the clock, expect for the intermediate gear and the motion gear and their associated pinions, are aligned along the single common axis. In accordance with certain features of the invention, the hour shaft and the minute shaft are tubular and the minute shaft is rotatable within the hour shaft. The second shaft is rotatable within the minute shaft.

In accordance with certain features of the invention, a back plate is within the housing oriented parallel to the face plate in proximity to a surface thereof, the space between the two plates forming a gear area. The hour gear, the motion gear, and the motion gear pinion are located in the gear area with the motion gear shaft coupled to the back plate so as to be axially supported thereby while permitting rotation of the motion gear shaft about its axis. The minute gear, the minute gear pinion, the intermediate gear, and the intermediate gear pinion are located in the gear area. The intermediate gear shaft is coupled to the back plate so as to be axially supported thereby while permitting rotation of the intermediate shaft about its axis. The ratchet wheel and the solenoid are located in an area outside of the gear area separated therefrom by the back plate.

In accordance with other embodiments of the invention which are involved in an electrical clock mechanism which include a main housing; a second hand; a second wheel rotatably about a first axis having a plurality of teeth oriented about its periphery with each tooth having a face portion oriented in a generally radial direction with respect to the wheel and having an inclined ramp portion connecting the face portion of one tooth to the face portion of an adjacent tooth; a second shaft connecting the axis of the wheel to the second hand; a ratchet wheel having the second wheel, a reciprocating lever adapted to reciprocate from one position to another, first pawl means for communicating motion to the second wheel, and second pawl means for preventing back motion of the wheel; and means for reciprocating lever, improvements can reside in either the first pawl means, the second pawl means or both. In accordance with one embodiment of the invention directed to the first pawl means, a first inwardly radially directed, toward the first axis, spring receiving housing is formed with respect to the reciprocating lever. A first spring has a first end housed within the first spring receiving housing. A first pawl member has a toothed portion, a spring engaging portion coupled to the second end of the first spring and a pivot axis parallel to the first axis. The first pawl member is coupled to the reciprocating lever at its pivot axis so as to be pivotable thereabout. The first toothed portion is engageable with a tooth on the second wheel. Thus, the first spring is so biased to urge the first pawl member toothed portion towards the first axis to engage a tooth on the second wheel. In accordance with the embodiment directed to the second pawl means, the second pawl means includes a support member coupled to the main housing. A second inwardly radial directed, toward the first axis, spring receiving housing is formed with respect to the support member. A second spring has a first end housed within the second spring receiving housing. A second pawl member has a toothed portion, a spring engaging portion coupled to a second end of the second spring and a pivot axis parallel to the first axis. The second pawl member is coupled at its pivot axis to the support member so that the second pawl member is pivotable thereabout. The second toothed portion is engageable with a tooth on the second wheel. Thus, the second spring is so biased to urge the second pawl member toothed portion toward the first axis to engage a tooth on the second wheel. With such embodiments, the first pawl is adapted to engage a tooth on the second wheel for communicating motion to the wheel, and a second pawl is adapted to engage a tooth on the second wheel for preventing back motion of the wheel.

In accordance with still yet another embodiment of the invention relating to an automobile clock mechanism having a housing, the embodiment includes a vertically disposed planar support member within he housing. Such member has a shaft receiving hole therethrough which divides the housing into two regions, a gear region and a ratchet wheel region. A horizontally disposed second shaft is rotatable within the shaft receiving hole for communicating intermittent rotary motion from the ratchet wheel region to the gear region, thus being able to directly drive a second hand and indirectly drive a minute hand and an hour hand. A ratchet wheel within the ratchet wheel region includes a toothed second wheel oriented distal to and parallel with the member and has its central axis affixed to the second shaft. One end of the wheel proximal to the member has a truncated portion extending therefrom. A reciprocating lever of self lubricating plastic, pivotable with respect to the shaft, is disposed between the member and the wheel. The lever has flat surface proximal to the second wheel and has a pair of rounded protuberances integrally formed therein proximal to the member. Pawl means for communicating motion to the wheel are coupled to the lever. Pawl means for preventing backward motion of the wheel are coupled to the member. The embodiment further includes means for reciprocating the lever so that, as the lever reciprocates, the rounded protuberances act as bearing surfaces against the member and, as the clock mechanism vibrates, the truncated portion of the wheel limits axial motion of the lever.

BRIEF DESCRIPTION OF THE DRAWING

Other objects, advantages and features of this invention will become more apparent from the following description, when read in conjuction with the accompanying drawings, in which.

GENERAL DESCRIPTION OF THE INVENTION

Figure 1:
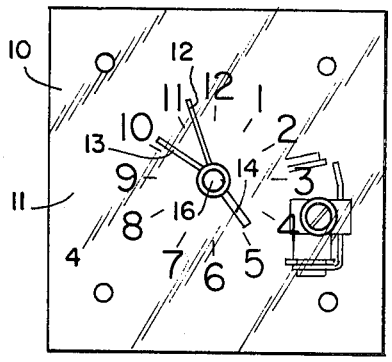
FIG. 1 is a front view of a clock mechanism in accordance with one embodiment of the invention, portions being shown partially transparent for purposes of orientation.

FIG. 1 illustrates a front view of a clock housing 10 having an analog dial face 11 with conventional concentric second hand 12, minute hand 13, and hour hand 14. The hands 12, 13, and 14 are concentric about a common axis 16.

THE ELECTRONICS

The clock mechanism, to be described hereinafter, is driven by electrical pulses which are applied to a solenoid 17. The pulses are applied at a one-second repetition rate and have, preferbly, a 10% duty cycle. The duty cycle can vary in a wide range; the precise choice is a matter of design of the electrical circuitry and of the solenoid 17 itself.

The repetitive electrical pulses can be provided in known manner, for example, by coupling a quartz oscillator circuit to a 12 volt automobile storage battery. The quartz crystal oscillator provides a constant oscillating frequency therefrom which is relatively stable, as is well known to those skilled in the art. The relatively high frequency can divided down by suitable circuitry so as to provide pulses having a one-second reptition rate. The electrical circuitry can include suitable means for shaping the pulses, for providing pulses of a fixed polarity, etc., as is well known to those skilled in the art. Such electrical circuitry can be provided on a printed circuit board with discrete components including transistors, resistors, capacitors and the like; it can include integrated circuits or other hybrid components. Such electronic devices do not form a part of this invention, it being well within a scope of the art that reliable, miniaturized, pulse forming and pulse shaping circuits are available.

THE MECHANICAL FEATURES

One Embodiment

Figure 4:
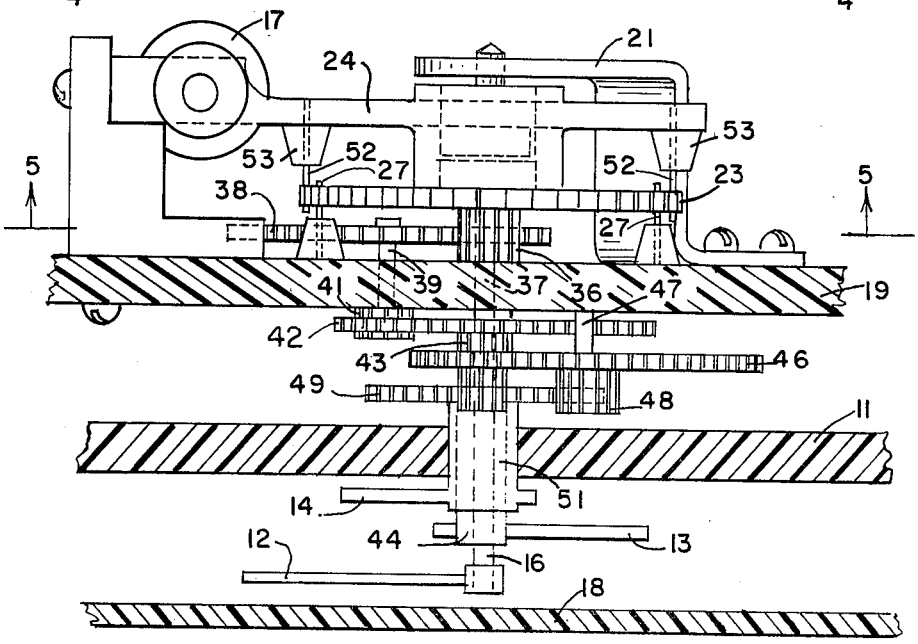
FIG. 4 is a bottom view, taken along the lines 4—4 of FIG. 3.

The housing 10 can include a front window 18, an analog dial face 11 which acts a face plate, and a back plate 19, as shown at FIG. 4. The back plate 19 supports the solenoid 17. A bracket 21, coupled to the back plate 19, provides support at the axis 16 for a ratchet wheel 22.

The ratchet wheel 22 includes a wheel 23, a reciprocating lever 24, pawls 26—26 for communicating motion, and pawls 27—27 for preventing back motion.

A spring pawl 127, affixed to the back plate 19, is coupled to the wheel 23 to permit counterclockwise rotation but to inhibit clockwise rotation (as viewed in FIG. 3) and is redundant therein. The spring pawl 127 can be used in lieu of the pawls 27—27 as an alternate embodiment.

Figure 2:
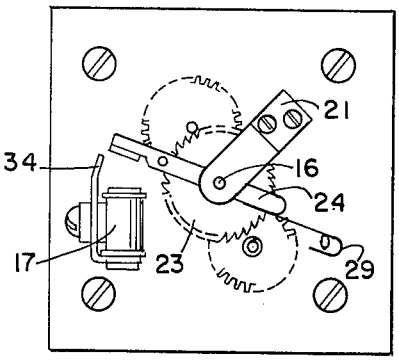
FIG. 2 is a rear view thereof, the rear of the housing being deleted for convenience.

The reciprocating lever 24, pivotable about the axis 16, has an armature 28 constructed of low remanent, high permeable material, such as soft iron. One end of the reciprocating lever 24 is coupled to a bent spring 29. In the unenergized position (shown at FIG. 2, and shown in dotted outline at FIG. 3), the spring 29 is not coupled to a support.

Figure 3:
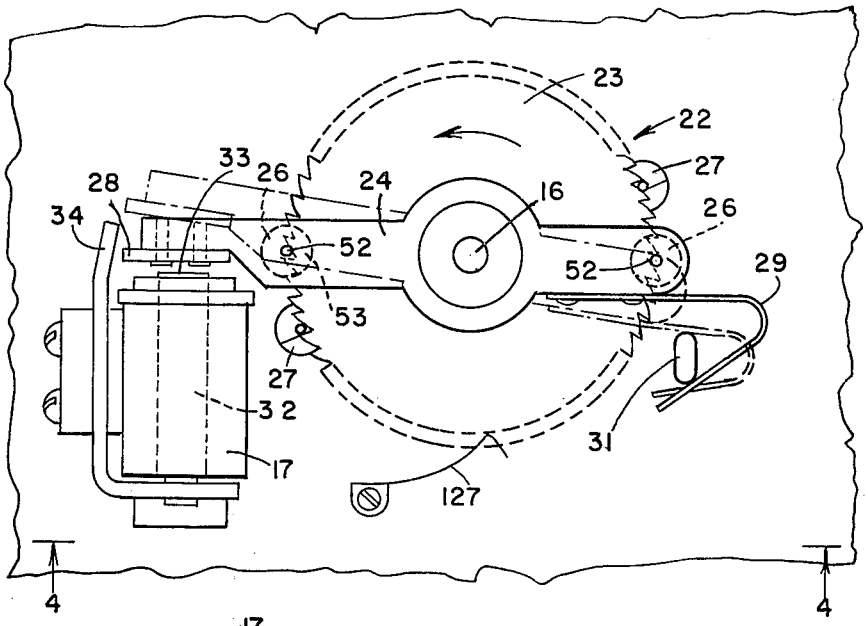
FIG. 3 is a rear view in greater detail, but with portions deleted.

When the reciprocating lever is pivoted about its axis 16, to the position shown in solid outline in FIG. 3, the unattached end of the spring 29 engages against a dog 31, which is affixed to the back plate 19, so that the spring 29 tends to return the reciprocating lever 24 back to its relaxed position. However, the magnetic force applied by the solenoid 17 is slightly greater than the force of the spring 29; the spring 29 does not return the lever 24 until the magnetic force is removed from the solenoid 17.

The electromagnetic solenoid 17 has a core 32 therethrough. A pole piece 34 is coupled at the bottom of the solenoid to the core 32 and is formed up about the side of the electromagnetic solenoid 17, and bent inwardly and above the pole piece 33. The electromagnetic solenoid 17, when energized, causes a magnetic field to be provided between the pole pieces 33 and 34. The magnetic field so provided has its maximum strength directed to an area above the pole piece 33 so that, when the solenoid 17 is actuated, the armature 28 is attracted to the high intensity magnetic field whereby the armature 28 does not physically contact the solenoid 17, either at the pole piece 33 or otherwise.

In essence, the armature tends to assume a position with respect to the pole pieces 33 and 34 so that the magnetic circuit, including the pole pieces 33, 34, the armature 28, and the air gaps therebetween, has a minimum reluctance path. In other words, in the solid position shown at FIG. 3, the effective sum of air gaps from the pole piece 33 to the armature 28 and from the armature 28 to the pole piece 34 is at a minimum. Where the armature to be at a touching or near touching position with either pole piece 33, 34, the effective air gap would be greater.

As the electromagnetic solenoid 17 is actuated, the wheel 33 is advanced, one tooth at a time. In view of the actions of the pawls 26—26 and 27—17, the reciprocating lever 24 can tend to advance the wheel 23 a rotational distance greater than one tooth but less than two teeth. Preferably, to provide for an economical system with less than critical tolerances, the reciprocating lever 24 should traverse a distance from its neutral position to the engaged position, a distance equal to one and half teeth (so as to allow for a tolerance of up to plus or minus one-half tooth). This assures that the wheel 23 is advanced but one tooth at a time, due to the pawls 26—26 which advance the wheel and due to the pawls 27—27 which prevent back motion of the wheel.

As stated above, when the reciprocating lever 24 is in its neutral position, the spring 29 is not engaged with the dog 31 and is, in effect, disengaged from any support with the housing 10. Thus, the only force necessary to initially attract the reciprocating lever 24 is that to overcome friction which may exist between the lever 24 and the axis 16 upon which it pivots. Were the spring 29 to be engaged with a support, additional energy would be required to initially cause the reciprocating lever 24 to pivot about the axis 16. Since the spring 29 is not so engaged, less energy is required to pivot the lever 24.

In electrical devices utilizing solenoids and armatures which repeatedly contact a pole piece of a solenoid, it is common that repeated contacts of an armature with the pole piece causes the armature to become residually magnetized. Hence, over a prolonged period of operation, the armature tends to adhere to the pole piece, even though the solenoid be deactivated. Such action is undesirable in applications where the armature should be disengaged from a solenoid when the solenoid is not activated. Such applications include clocks, as described herein, but also include other devices.

Thus, a desirable feature of this invention is that the armature 28 of the reciprocating lever 24 does not physically contact the solenoid 17 or the pole pieces 33, 34. The armature 28, when the solenoid 17 is actuated, comes to rest at the solid line position shown at FIG. 33 where the magnetic field is at its maximum, due to the physical location of the unique shape of the pole piece 34 in cooperating relation to the pole piece 33. Hence, when the solenoid 17 is deactivated, the spring 29 causes the reciprocating lever 24 to pivot back to its neutral position without having to overcome any residual magnetism effects.

As shown at FIG. 4, the wheel 24 has a pinion 36 formed on its axis and has a second hand shaft 37 extending therefrom. The second hand shaft 37 extends through the back plate 19, through the face plate 11, and is affixed to a second hand 12.

The pinion 36 drives an outboard intermediate gear 38. The outboard intermediate gear 38 rotates about its shaft 39 within a suitable opening in the back plate 19. A pinion 41 is physically attached to the shaft 39 on the opposite side of the back plate 19.

The outboard intermediate gear pinion 41, as shown at FIG. 4, drives a minute gear 42. The minute gear has a pinion 43 coupled axially therewith and has affixed thereto a minute tube 44 which passes through the axial opening in the face plate 11 and is coupled to the minute hand 13. Within the minute tube 44 is the concentric shaft 39 associated with the second hand.

The minute gear pinion 43 drives an outboard motion gear 46 which is pivotable about an axis 47 which can be affixed for rotational movement to the back plate 19. The minute gear has extending axially therefrom a pinion 48. The pinion 48 is adapted to drive an hour gear 49.

The hour gear 49 is coupled to an hour tube 51 which passes through the opening in the face plate 11, to the hour stand 14. Thus, the second hand shaft 37, the minute tube 44, and the hour tube 51 are concentric with respect to each other.

As can be seen from the foregoing description of the embodiment depicted in FIG. 4, the hour gear 49, the minute gear 42 with its associated pinion 43, and the wheel 23 with its associated pinion 36 are all rotatable about the same axis and concentric therewith. Only two gears have been described together with their associated pinions which are not physically located about the common axis. Those two gears are the outboard intermediate gear 38 and its associated pinion 41, and the outboard motion gear 46 with its associated pinion 48. Thus, it can be seen that wide extremes in temperature can occur without undue problems caused by expansion and contraction due to heat and cold. Contrary to prior art devices wherein many gears are in many different sets of axes, and contraction and expansion causes gears to bind or provide sloppy interaction, the provision of all but two gears on a common axis tends to reduce the amount of binding or sloppiness that otherwise would be present.

A suitable pawl 26 for communicating motion is best shown in FIGS. 5, 5A, 5B, and 5C. The pawl 26 includes an elongated music wire 52 embedded into a recess in the reciprocating lever 24. The music wire 52 can be forceably fit into the reciprocating lever 24; it can be affixed thereto by cement or so shaped as to be attached thereto such as by grooves and ridges and the like. The music wire 52 can be formed of suitable materials such as nichrome or other metal or alloy. The pawl 26 further includes a support member 53 which is affixed to the reciprocating lever 24. The support member 53 can be formed of the same material as the reciprocating lever 24 and can be formed integrally therewith. The support member 53 essentially is a cylindrical mass of material with one quadrant removed at a portion 54 away from the reciprocating lever 24.

Figure 5:
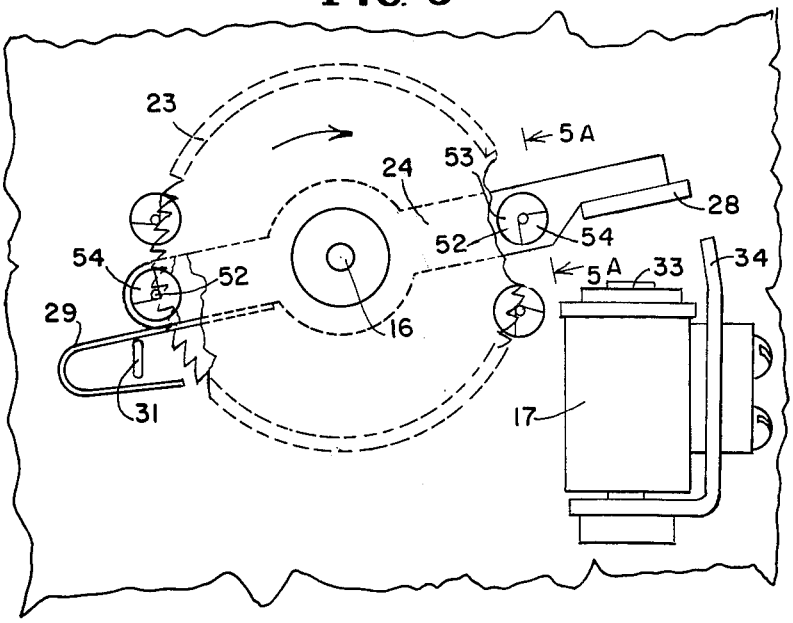
FIG. 5 is an inverted view taken along the lines 5—5 of FIG. 4.
Figure 5A:
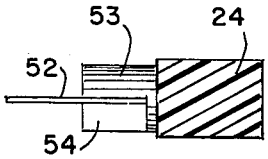
FIGS. 5A, 5B, and 5C are sectional views taken along the lines 5A—5A of FIG. 5, showing as one embodiment of the invention, a pawl for communicating motion in an unstressed, engaging, and disengaging conditions, respectively.

As can be clearly shown from FIG. 5 and FIG. 5A, there is depicted the pawl 26 in a relaxed condition wherein the music wire 52 extends outwardly from the reciprocating lever 24 and the support member 53, and is shown in a straight condition, the music wire being unstressed at that point.

Figure 5B:
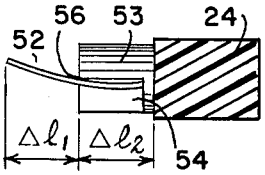

As the solenoid 17 is actuated, the armature 28 is attracted toward the magnetic field which is set up across the pole pieces 33 and 34. The music wire 52 engages with a tooth on the wheel 23 and drives the wheel 23 a distance greater than one tooth length and less than two teeth length. As the music wire 52 drives the wheel 23, the music wire 52 is slightly deformed as depicted in FIG. 5B. As shown by FIG. 5B, which is the driving position for driving a tooth, the music wire 52 is supported about half the length thereof by the support member 53 so that the music wire 52 is somewhat restrained from bending about its entire length since the end 56 of the support member 53 acts as a pivot point for the music wire 52. Thus, essentially, the flexure of the wire 52 occurs along the length $\Delta l1$ from the end 56 to the extremity of the music wire 52. It is noted, however, that some bending occurs during the remaining portion of the music wire 52 along the length $\Delta l2$ as shown clearly in FIG. 5B.

Figure 5C:
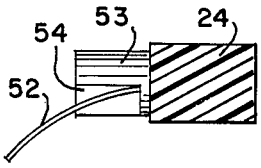

When the solenoid 17 is deactivated, the spring 29, acting against the dog 31 tends to return the reciprocating lever 24 back to its neutral position and, in doing so, the music wire 52 is free to flex about its entire length as indicated and clearly shown at FIG. 5C since the support member 53 enables the music wire 52 to flex within the removed quadrant portion 54. Thus, the pawl 26 operates in a unique manner in that the effective length of the music wire is changed in its two conditions of operation. Namely, the effective length of the music wire is short when it drives a tooth of a ratchet wheel and is long when it retracts past the inclined ramp of a tooth on the ratchet wheel.

DESCRIPTION OF ANOTHER EMBODIMENT OF THE INVENTION

Figure 6:
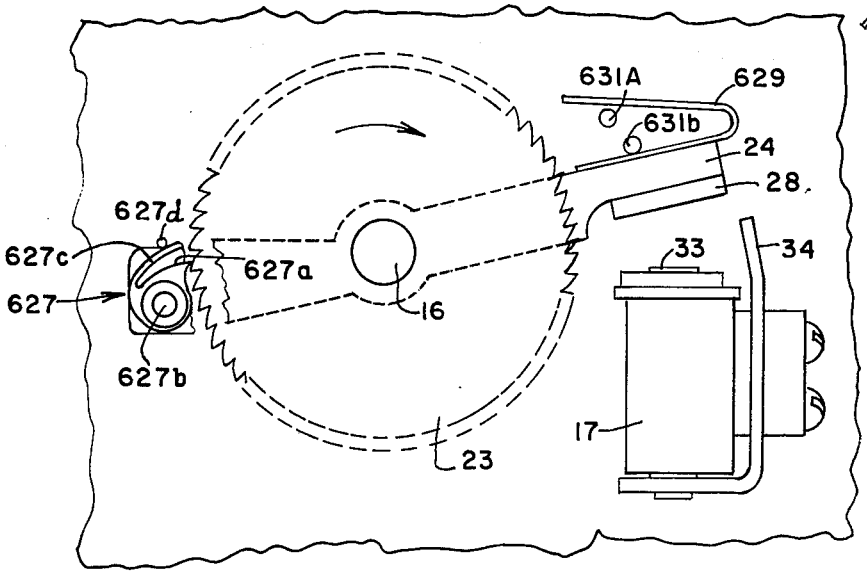
FIG. 6 is a view similar to that of FIG. 5 but showing another embodiment of the invention.
Figure 10:
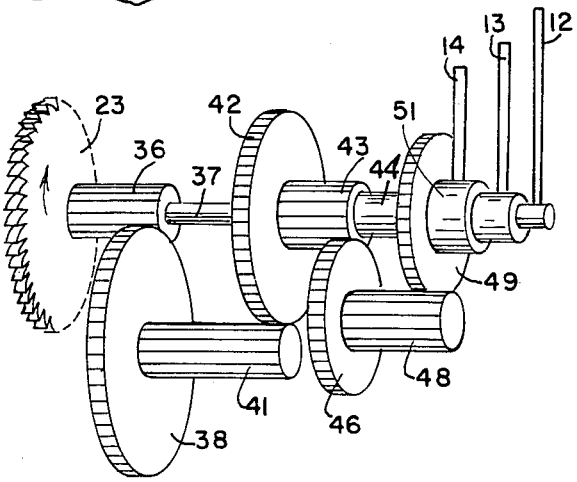
FIG. 10 is a diagrammatic view illustrating the connections of the various gears, wheels and timing hands of an embodiment of this invention.

Another embodiment of the invention is depicted at FIG. 6 wherein corresponding reference nunerals are applied to corresponding and like elements as those depicted in the lower numbered figures of the drawing. Similar parts, however, are shown with reference numerals in amount 600 higher. Thus, as depicted in FIG. 6, the solenoid 17 has pole pieces 33 and 34 similar to that described hereinabove. However, a spring 629 is affixed to the reciprocating lever 24 at the armature end thereof in lieu of the spring 29 being at the opposite end as shown, for example, at FIG. 5. The spring 20 has associated therewith a pair of dogs 631A, 631B. The two dogs 131A and 131B effectively can operate as a single dog, since they can take various forms. In the neutral position indicated at FIG. 6, the spring 629 is not held by the dogs 631A or 631B, the advantages being very similar to the dog 31 as depicted in FIG. 5. However, clarity of the description may be somewhat easier to follow at FIG. 6, in that, as the armature 28 of the reciprocating lever 24 is attracted towards the pole pieces 33 and 34 of the solenoid 17, the spring 629 touches the dog 631A, causing the spring 129 to both bend about the dog 631A and slide to a certain degree with respect thereto since the spring 629 is not permanently affixed to the dog 631A. Thus, little power is expended in causing the reciprocating lever 24 to move or pivot about the axis 16, due to the sliding characteristics of the spring 629 with respect to pawl 131 thereof. As the reciprocating lever 24 is free to rotate back to its neutral position, due to the de-energization of the solenoid 17, the spring 629, acting against the dog 631A, causes the reciprocating lever 24 to tend to return to its original position. At an intermediate point or position, the spring 629 tends to be free of engagement with the dog 631A and the reciprocating lever 24 overshoots the engaged springed position and comes to a stop when the reciprocating lever 24 touches the dog 631B.

Various pawls can be used for preventing back motion of the wheel 23. They can include the pawls 27—27 shown in FIG. 3, which essentially can be a type similar to those depicted in FIGS. 5A, 5B, and 5C; they can take the form depicted as pawl 627 at FIG. 6.

As shown in FIG. 6, a plastic pawl 627 is an integral unit and has a tooth 627A which engages with the teeth of the wheel 22. The pawl 627 is pivotably supported about its axis by a shaft 627B which is affixed to the back plate 19. The pawl 627 has an extending spring portion 627C which biases against a stud 627D which is affixed to the back plate 19. Thus, as shown in FIG. 6, the tooth 627A is free to ride over the inclined ramp portion of a tooth on the wheel 23 when the wheel 23 is driven in the clockwise direction as shown in FIG. 6 with the tooth 627D tending to be compressed toward the spring portion 627C of the pawl 627. As the reciprocating lever 24 is permitted to return to its neutral position, the pawl 627, being compressed, tends to return towards its relaxed position causing the tooth 627A to be urged inwardly toward the common axis 16 thereby tending to drive the wheel 23 in a counterclockwise direction until the tooth 627A engages the face of the tooth on the wheel 23, thereby holding the wheel 23 in a stopped position.

DESCRIPTION OF ANOTHER EMBODIMENT

Figure 7:
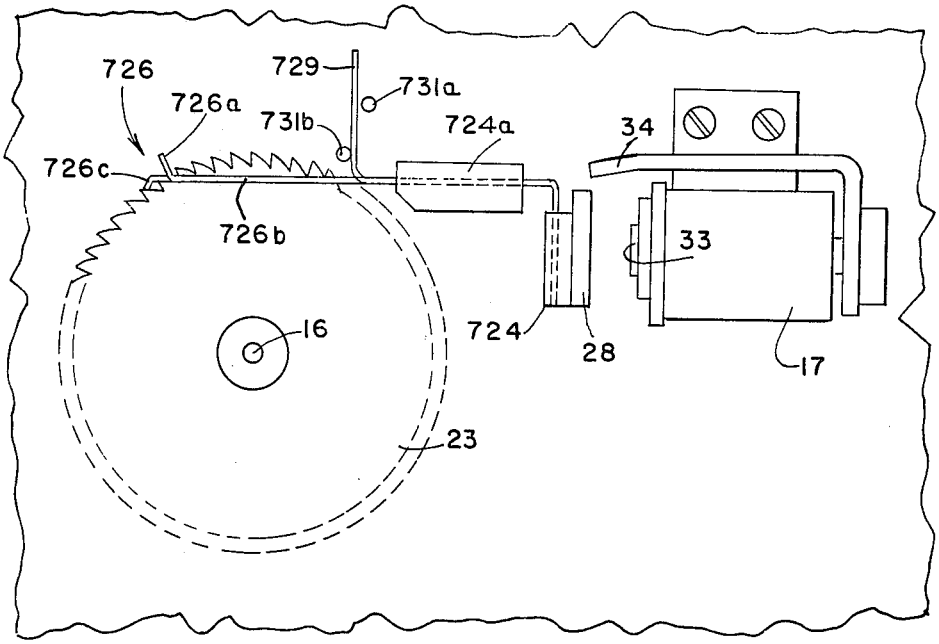
FIG. 7 is a view similar to that of FIG. 6 but showing yet another embodiment of the invention.

Referring to FIG. 7, there is depicted an alternate embodiment of the invention, wherein like elements similar to those of FIG. 5 are depicted by like reference numerals, and substitute elements which effectively perform similar functions are depicted with reference numerals greater than 700. Thus, as shown, a solenoid 17 includes pole pieces 33, 34 which attract an armature 28 when the solenoid 17 is actuated. However, the ratchet wheel includes a wheel 23, a reciprocating member 724 which is affixed to the armature 28, a pawl 726 for communicating motion to the wheel 23, and a spring 729 which engages with dogs 731A ad 731B. Not depicted in FIG. 7 is a pawl for preventing back motion for clarity of description. Such a pawl for preventing back motion can take a form indicated in the lower numbered figures as pawl 27, 127, 627 or other suitable alternative. Also, depicted in FIG. 7, is a support block 724A for the reciprocating member 724.

The pawl 726 for communicating motion to the wheel 23 includes a tab 726A which is an integral portion of an elongated stiff spring 726B which is coupled to the reciprocating member 724 so that, when the reciprocating member 724 is attracted by its armarture 28 to the pole pieces 33 and 34 of the solenoid 17, the tab 726 engages the face of a tooth on the wheel 23 causing the wheel 23 to rotate clockwise as viewed in FIG. 7. The pawl 726 further includes an inclined tab 726C which, when the reciprocating member tends to return to the neutral position, causes the tab 726C to rise over the inclined ramped tooth of the wheel 23, riding thereover until the tab 762A engages a face of the next tooth. When in the neutral position, the stiff spring 726B tends to force the tab 726C radially inwardly toward the wheel 23 causing the wheel 23 to rotate counterclockwise until the tab 726A engages the face of a tooth on the wheel 23.

The support block 724A is affixed to the back plate 19 by known means such as by rivets or bolts, and permits the reciprocating member 724 to slide with respect thereto, the stiff spring 726B forming an integral portion of the reciprocating member 724. The spring 729 is affixed to the stiff spring 726B and, hence, a portion of the spring 729 is permitted to reciprocate within a support block 724A.

The support block 724A provides dual functions. The main purpose of the support block 724A is to provide support for the reciprocating member 724 and its corresponding spring 726B and 729. One function of the support block 724A in assuring linear reciprocating motion is to assure that the tab 726A positively engages a tooth on the wheel 23 when the armature 28 is attracted toward the pole pieces 33, 34 of the solenoid 17 and so that the tab 726C properly engages the inclined ramp of a tooth on the wheel 23 when the member 724 is permitted to return to its neutral position. The other function of the support block 724A is to insure that, when the armature 28 is attracted toward the pole pieces 33 and 34, the armature 28 travels a straight path toward the solenoid 17 and does not travel an arcuate path in such a manner so that the armature 28 touches the pole piece 34. Thus, the support block assures that the armature 28 reciprocates along a straight line.

DESCRIPTION OF YET ANOTHER EMBODIMENT OF THE INVENTION

Figure 8:
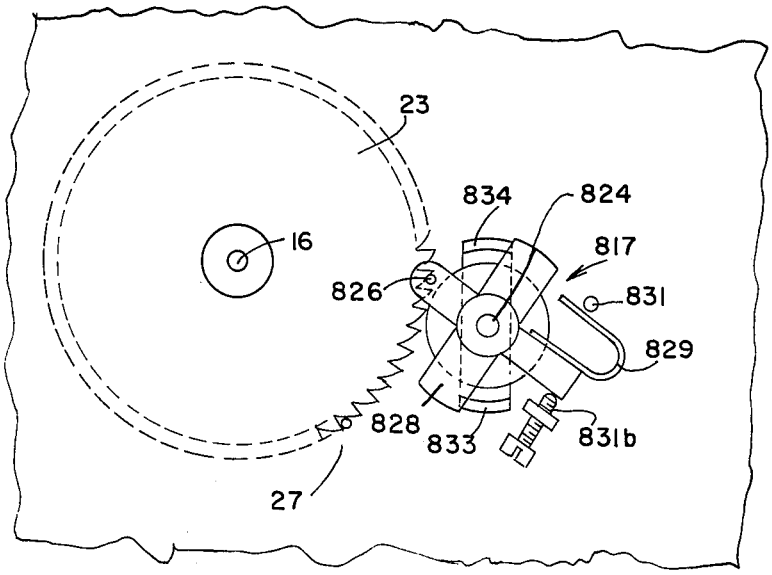
FIG. 8 is a view similar to those of FIGS. 5, 6, and 7 showing still yet a further embodiment of the invention.
Figure 9:
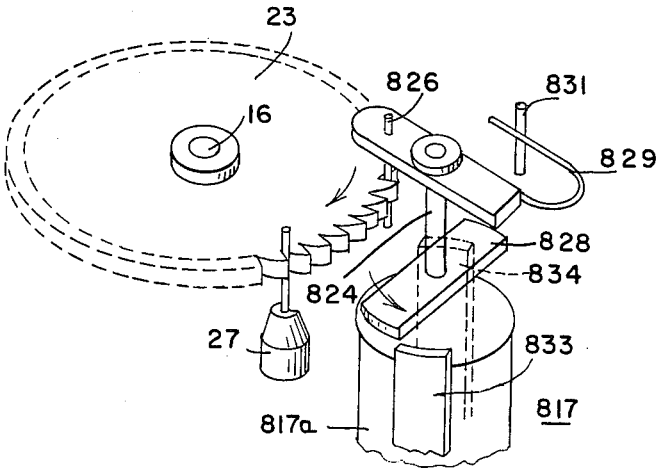
FIG. 9 is a perspective view illustrating the embodiment shown in FIG. 8.

FIGS. 8 and 9 illustrate yet another version for driving a wheel 23 of a ratchet wheel and contain reference numerals of like number as that depicted in FIGS. 1 through 5 inclusive, which reference numerals indicate like components. However, corresponding elements which provide similar functions, but in a different manner are designated with reference numerals in the 800 series. Thus, a wheel 23 of a ratchet wheel rotates about its axis 16 as shown at FIGS. 8 and 9. A rotary solenoid 817 is utilized; however, in lieu of a conventional solenoid 17.

The rotary solenoid includes a coil 817A with associated pole pieces 833 and 834 which are located on diametrically opposite sides of the solenoid 817 at one end thereof spaced a short distance away from the coil 817A. An armature 828 is affixed to a shaft 824 which reciprocates in an angular direction only, but does not reciprocate in a linear or axial direction. The shaft 824 has a pawl 826 affixed thereto for communicating motion to a corresponding tooth on the wheel 23. Also attached to the pawl 826 and, hence, to the shaft 824, is a spring 829 having a free end thereof adapted to engage against a dog 831 which is coupled to the back plate 19. As depicted in FIG. 9, a pawl 27, which is coupled to the back plate 19, is used for preventing back motion of the wheel 23, the pawl 27 engaging the corresponding teeth of the wheel 23 in a manner as set forth hereinabove in connection with other figures of the drawing. A stop 831B can be used as shown in FIG. 8 to restrict the motion of the pawl 826.

As shown in FIGS. 8 and 9, the device shown is in its relaxed or neutral position. Upon energizing the rotary solenoid 817, a magnetic field is set up across the pole pieces 833 and 834. The armature 828, being provided of low remanent, high permeable material such as soft iron, tends to be attracted thereto and, hence, since the only freedom of motion of the armature is in a rotary direction, causes a shaft 824 to rotate. As the shaft 824 rotates, the pawl 826 affixed thereto likewise rotates, all the foregoing rotation occurring in a counterclockwise direction. The rotation occurs until the armature 828 is aligned with the pole pieces 833 and 834. That is, as shown in FIG. 8, the armature 828 rotates from the position shown into a vertical position, and, as shown in FIG. 8 tends to rotate counterclockwise approximately 30 degrees, tending to stay at that aligned position as long as the coil 817A is energized. The counterclockwise rotation of the pawl 826, in engaging a tooth on the wheel 23, causes the wheel 23 to rotate in a clockwise direction. The pawl 27, as shown in FIG. 9, tends to rise over the ramped face of the tooth of the wheel 23, past the next face thereof, onto a portion of the next ramp of the subsequent tooth. Upon de-energizing the solenoid 817, the spring 829 tends to cause the pawl 826 to rotate clockwise into the neutral position depicted in FIGS. 8 and 9 whereby the spring 829 is disengaged or inactivated with respect to the dog 831 and, in such neutral position, the pawl 826 does not exercise any force against the wheel 23. Upon arriving at a neutral position, the pawl 27, being upon the following ramped surface of the subsequent tooth, applies a force against the wheel 23 via the ramped surface causing the wheel 23 to rotate a fraction of a tooth in a counterclockwise direction until the pawl 27 engages against the back face of a tooth thereby preventing back motion of the wheel 23.

DESCRIPTION OF YET ANOTHER EMBODIMENT OF THE INVENTION

Figure 12:
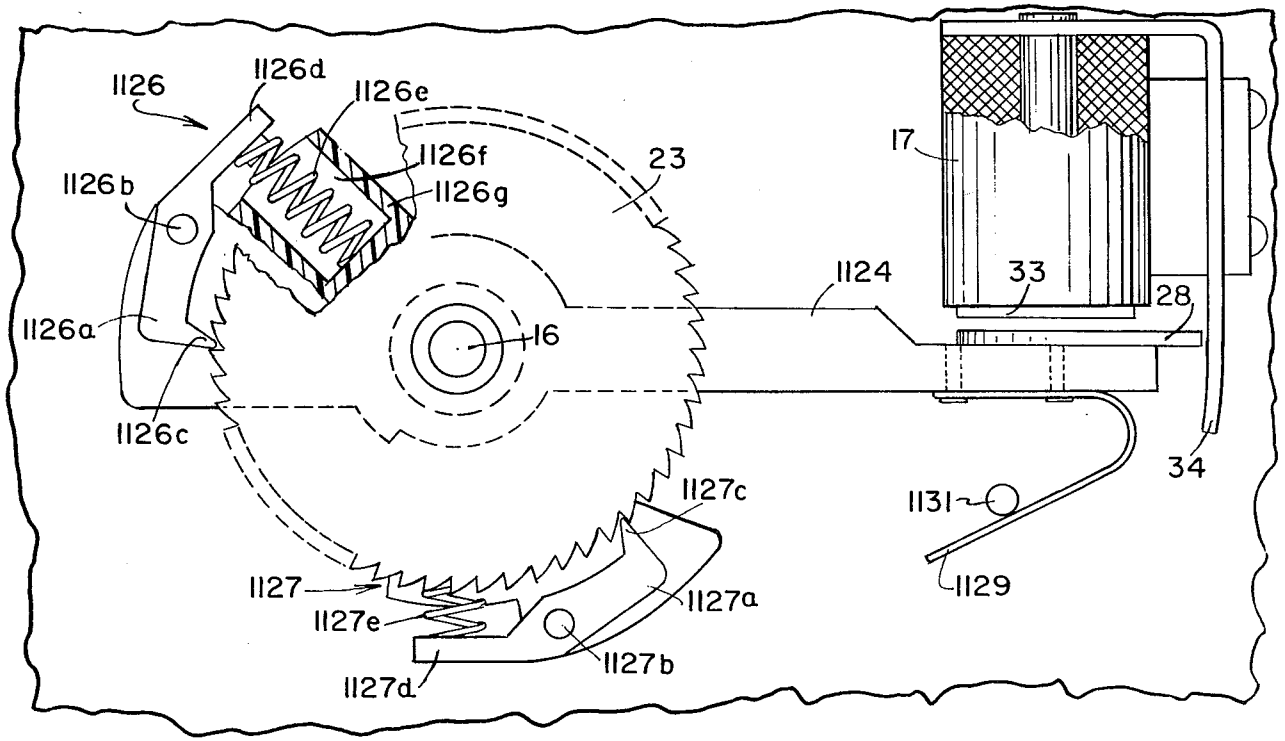
FIG. 12 is a view, partly in section, taken along the lines 12—12 of FIG. 11.
Figure 11:
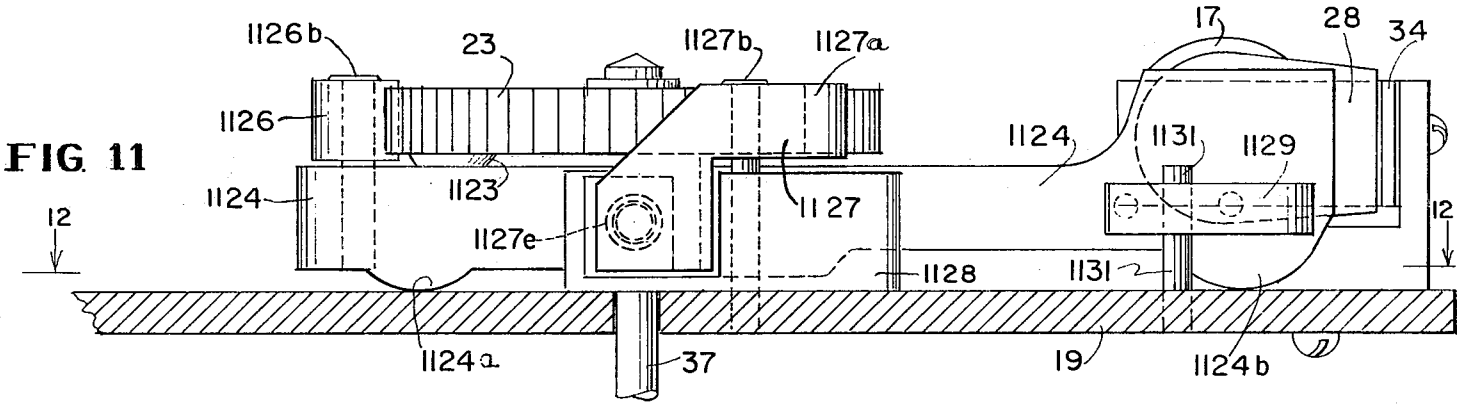
FIG. 11 is a top view of a portion of still yet another embodiment of the invention.

Another version for advancing the wheel 23 of a clock mechanism is depicted in FIGS. 11 and 12. As heretofore, like reference numerals are depicted for corresponding elements such as the wheel 23 and the common axis 16. Elements which perform similar functions as those depicted in FIGS. 1 through 5 are designated with reference numerals in the 1100 series.

Figure 13:
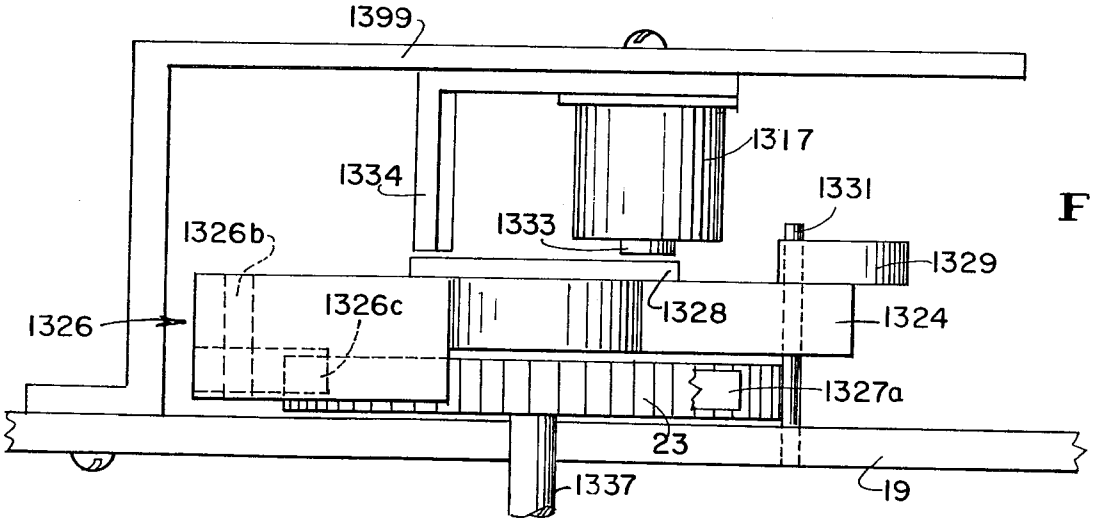
FIG. 13 is a side view of another embodiment of the invention.

Referring to FIGS. 12 and 13, there is shown a preferred embodiment of the invention including a solenoid 17 affixed to the base plate 19. THe solenoid 17, as in the other embodiments of the invention, includes pole pieces 33 and 34.

The second hand 12 and the second hand pinion 36 (not shown in FIGS. 11 and 12) are driven by a ratchet wheel.

The ratchet wheel embodiment depicted in FIGS. 11 and 12 includes a toothed wheel 23, a reciprocating lever means 1124, pawl means 1126 for communicating motion, and pawl means 1127 for preventing backward motion.

The wheel 23 contains a plurality of teeth, each tooth having a face portion which is radial with respect to the wheel 23 and an inclined ramp portion which couples the face of one tooth to the face of an adjacent tooth. The wheel 23 is coupled at its axis to drive the second hand shaft 37 and the second hand pinion (not shown). The wheel 23 has a truncated portion 1123 which extends outwardly from the plane of the wheel 23 toward the base plate 19. The purpose of the truncated portion 1123 is to limit vertical movement (as viewed in FIG. 11) of the lever 1124 due to any vibration.

As will be recalled in the embodiment of FIG. 4, the wheel 23 was oriented between the base plate 19 and the reciprocating lever 24. Contrariwise; in the embodiment depicted in FIGS. 11 and 12, the lever 1124 lies between the wheel 23 and the back plate 19.

The reciprocating lever means 1124 is pivotable about the axis 16 and, at one end of the reciprocating lever means 1124, an armature 28 of low remanent, high permeable material such as soft iron is attached thereto. Affixed to the armature end of the reciprocating lever 1124 is a bent flat spring 1129 which is adapted to slideably engage with a dog 1131, the dog 1131 being affixed to the back plate 19.

The view as depicted in FIG. 12 is one in which the solenoid 17 is actuated so that the armature 28 of the reciprocating lever 1124 is attracted by the pole pieces 33 and 34 and, hence, in the position shown, the reciprocating lever 1124 is shown in the actuated position. In such actuated position, the spring 1129 engages the dog 1131 and applies a bias to the reciprocating lever 1124 tending to retract the reciprocating lever 1124 away from the solenoid 17. In the inactivated condition, when the solenoid 17 is de-energized, the reciprocating lever 1124 assumes a position as viewed in FIG. 12, approximately 8° clockwise therefrom. At such position, the spring 1129 does not contact the dog 1131, there being a space between the two elements.

The reciprocating lever 1124 has, at opposite sides of its base, rounded protuberances 1124A and 1124B which protuberances enable the reciprocating lever 1124 to slide with respect to the base plate 19. To enhance the sliding characteristic, it is desired that the reciprocating lever 1124 (including the protuberances 1124A and 1124B which are integrally formed in the lever 1124) be constructed of a self-lubricating plastic such as that manufactured by the DuPont Corporation under the trademark name "Celcon."

The pawl 1126 is pivotable about an axis 1126B with respect to the reciprocating lever 1124. A tooth 1126C of the pawl 1126 engages the face of a tooth on the wheel 23 to drive the wheel in a counterclockwise direction when the solenoid 17 is actuated.

The pawl 1126 extends from the tooth engaging portion with the wheel 23 downwardly (as depicted in FIG. 11) toward the lever 1124 to the opposite end 1126D thereof which provides an extended portion which engages with a spring 1126E. The spring 1126E is housed within a radial recess 1126F including a wall 1126G of the reciprocating lever 1124.

The pawl means 1127 for preventing backward motion includes a pawl 1127A which is pivotable about an axis 1127B which is fixed. The axis 1127B is the axis of a pivot pin which is affixed via a support block 1128 which is directly affixed to the back plate 19. The pawl 1127A has a tooth portion 1127C which is adapted to engage the teeth of the wheel 23 so as to prevent back motion thereof, the tooth 1127C of the pawl 1127A being adapted to engage with the face of a tooth on the wheel 23. The pawl means 1127 is so formed that it extends from the pawl 1127A, which engages with the wheel 23, downwardly (as shown at FIG. 11) to an opposite end 1127D so as to engage with a spring 1127E within a radial recess formed by a wall of the support block 1128.

In operation, as the solenoid 17 is actuated, the armature 28 is attracted to the magnetic field set up across the pole pieces 33, 34 so that the reciprocating lever 1124 tends to assume the position shown in FIG. 12. As it proceeds from the inactivated to the activated position, the spring 1129 touches the dog 1131 sliding therewith and is biased thereby. The spring 1126E, being under compression, tends to urge the tooth 1126C of the pawl 1126A radially inwardly toward the wheel 23. The tooth 1126C engages the face of a tooth on the wheel 23 and advances the wheel 23 a distance of eight degrees. Meanwhile, as the wheel is being advanced the eight degree distance, the tooth 1127C is urged in a clockwise direction, due to the tooth 1127C being urged by the inclined ramp of a tooth on the wheel 23 until the tooth is traversed. The spring 1127E, being under compression, urges the tooth 1127C radially inwardly toward the wheel 23.

As the armature 17 is de-energized, the reciprocating lever 1124 rotates clockwise eight degrees whereby the tooth 1126C of the pawl means 1126 traverses backward past one tooth. In so doing, the pawl 1126C prepares for the next operation. Meanwhile, the pawl 1127 operates in such a manner via the tooth 1127C being urged against the inclined ramp of a tooth on the wheel 23 to cause the wheel 23 to move approximately two degrees clockwise until the tooth 1127C engages the face of a tooth on the wheel 1123, thereby preventing any further back motion of the wheel 23.

In this embodiment, the mechanism can be extremely compact. For example, as shown in FIG. 11, the total distance from the top of the wheel 23 to the top surface of the back plate 19 can be a distance of 0.250 inch. The thickness of the reciprocating lever at the left hand portion of the drawing can be a distance of 0.130 inch, while the distance of the reciprocating lever at the left hand portion of the drawing including the protuberance 1124A can be a distance of 0.150 inch. The dog 1131 can extend outwardly from the back plate 19 by a distance of 0.120 inch and the width of the spring 1129 can be a distance of 0.070 inch.

The embodiment shown in FIGS. 11 and 12 has various advantages which are somewhat unique, one specifically, to function effectively in a vibrating environment, such as during automobile driving. Also, the embodiment shown in FIGS. 11 and 12 is well suited for operation under a wide range of temperature differences. Note, for example, that the pawl 1126 is carried by an axis on the lever 1124, and, regardless of temperature change, the pawl means 1126 is constantly urged inwardly toward the teeth on the wheel 23. It is noted that it is not necessary that the axis 1126B, with respect to the axis 16, be oriented with any high degree of precision. Hence, such a pawl means, and clock, is comparatively simple and economical to manufacture.

Likewise, the pawl 1127 is pivotable about an axis 1127B which is fixed with respect to the support block 1128 and the back plate 19. The pawl 1127 is continuously urged inwardly toward the teeth on the wheel 23 by the spring 1127E. In similar fashion, the tolerance location of the axis 1127B with respect to the axis 16 is not essential since it can vary over a wide range, due to temperature manufacturing tolerances, for example.

DESCRIPTION OF A FURTHER EMBODIMENT OF THE INVENTION

Figure 14:
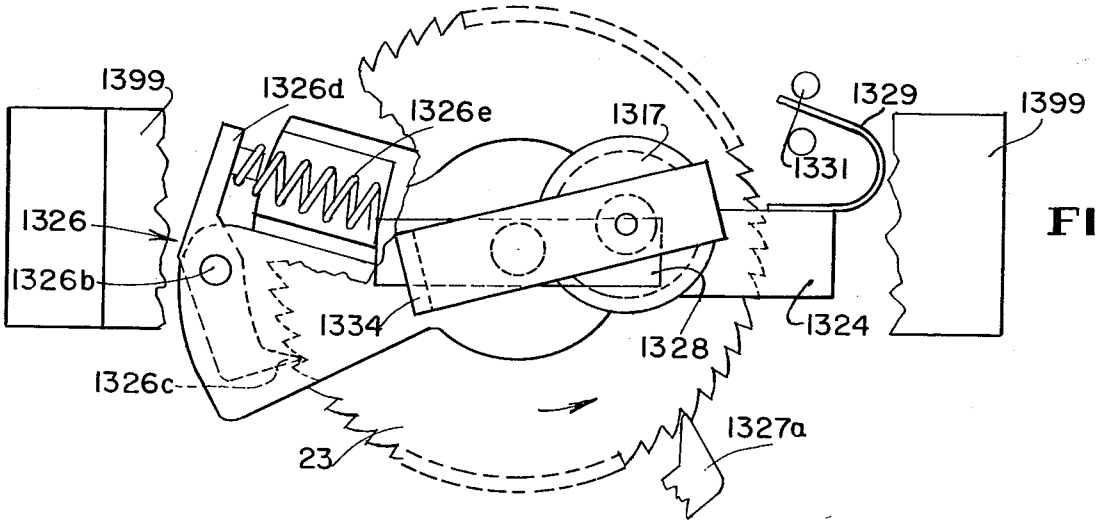
FIG. 14 is a top view of the embodiment shown in FIG. 13.

Referring to FIGS. 13 and 14, there is shown still yet another embodiment of the invention. The principles of operation are similar to the embodiment depicted in FIGS. 8 and 9; however, the circular solenoid is disposed above an armature of the reciprocating lever in such a manner that the armature is oriented concentric with the main axis 16 and the armature 1317 has its two poles 1333 and 1334 disposed at opposite ends with its central axis aligned with the axis 16.

As before, like reference numerals refer to like referenced parts set forth in the earlier figures of this description. However, those elements which operate in a similar fashion, but are not identical, are set forth with reference numerals in the 1300 series.

Referring to FIG. 13, there is shown a ratchet wheel 23 which is located adjacent to the back plate 19, as similarly described in connection with the embodiment depicted in FIG. 4. The ratchet wheel 23 is coupled by its pinion (not shown) to drive an intermediate gear (not shown) which in turn drives other gears for moving the minute and hour hands. The ratchet wheel 23 is coupled via its shaft to directly drive a second hand 12.

The reciprocating lever 1324 is oriented above (as viewed in FIG. 13) the ratchet wheel 23, in a similar fashion to that depicted in FIG. 4. However, the ratchet wheel 1324 has a pawl 1326 formed with respect to the lever 1324 downwardly so as to engage a tooth of the wheel 23. The reciprocating lever 1324 is coupled to a spring 1329 which is engageable with respect to a dog 1331. The spring 1329 and the dog 1331 operate in a manner similar to the dogs and springs 29, 31; and 1129, 1131.

The reciprocating lever 1324 at the central axis thereof (which axis is aligned with the main axis 16) has an armature 1328 disposed on its upper surface. The armature 1328 is constructed of magnetic material and has one-half portion thereof magnetized in a north direction and the other half portion thereof magnetized in a south direction. The armature 1328 can take the shape shown in FIG. 14 which is elongated, or it can take a circular configuration, as may be desired.

A pawl for preventing back motion (not shown for clarity of description) can be formed in a manner similar to the pawl 1127 depicted in FIG. 12.

Disposed above the armature 1328 is a solenoid 1317 which has a core therethrough (not shown). At one end of the core is a pole piece 1333. At the other end of the core is a pole piece 1334 affixed thereto and extending laterally and downwardly (as viewed) towards the armature 1328. Thus, when an electrical pulse of suitable polarity is applied to the solenoid 1317, the pole piece 1333 is magnetized in a north oriented polarity, while the pole piece 1334 is magnetized in a south oriented polarity. The orientations of such pole piece 1333 and 1334 attracts the unlike poles of the armature 1328 so that the armature is aligned at its respected poles with the unlike poles of that generated by the pole pieces 1333 and 1334.

The armature 1338, via the pole piece 1334 can be affixed to the housing 10. Alternately, the mounting plate 1339 can be affixed to other portions of the housing such as the back plate 19.

A significant advantage of the device depicted in FIGS. 13 and 14 is that of less space. Components can be oriented along the common single axis. Hence, in a lateral direction, very little space is necessary. With such an embodiment, no mechanical disadvantages are apparent from a mechanical advantage standpoint. From a mechanical point of view, a weaker return spring can be utilized, since the power requirements are minimized. Also, for attraction of the lever to the proper position, less power is required because the retraction occurs only for the pitch of the tooth, instead of being lever wise enlarged. By this arrangement, mechanical disadvantages can be eliminated.

DESCRIPTION OF YET ANOTHER EMBODIMENT OF THE INVENTION

Figure 15:
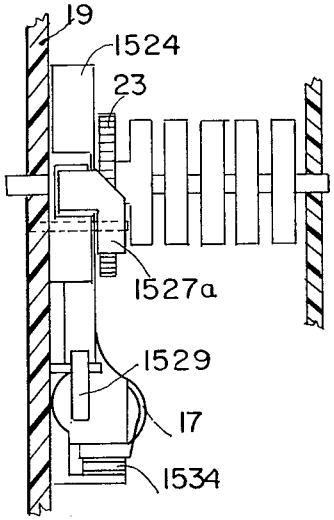
FIG. 15 is a view of yet another embodiment of this invention.

Referring to FIG. 15, there is shown a schematic diagram of a digital clock mechanism utilizing a ratchet wheel and armature set forth in accordance with the principles relating to FIGS. 1–14. The ratchet wheel is coupled to directly drive a seconds drum, and, preferably, the ratchet wheel is molded to also function as a seconds drum in a digital clock. The seconds drum can be coupled in known fashion to drive a minute drum, an hour drum, and, if desired, a ten hour drum using known digital techniques. No additional gear train is required, the gear train being eliminated which would normally appear in an analog clock.

IN GENERAL

Various modifications can be performed without departing from the spirit and scope of this invention. For example, the term automobile clock is not to be construed as limited to automobiles, since such clocks can be used in similar environments as trucks, motorcycles, boats, and airplanes, such clocks being normally operable in a temperature range of −40° F. to +180° F. Such clocks can also be used as a battery clock for home or office.

Though the terms "horizontal" and "vertical" are used in the claims for convenience of reference, it is not meant that such terms be limited as such, since the clocks described herein can operate upside down, rotated 90°, or otherwise oriented in a different manner. The clocks described herein are not position sensitive.

Though a preferred mode of operation is for the clock to be advanced one second at a time, it is understood that other intervals may be employed, such as 1/5 second, ½ second, 2 seconds, and the like.

The principles of an analog operation as described herein can be employed in a digital clock, using known digital clock mechanisms, without departing from the spirit and scope of this invention.

What is claimed is:

1. In an electrical automobile clock having a housing; a face plate within said housing, said face plate having a dial face normally viewable at one surface thereof and having an opening therein from said one surface to an opposite surface thereof; hour, minute, and second hands which rotate about a common concentric axis; and pulsing means for converting direct current to a series of electrical pulses having a repetition rate *t;* the improvement comprising:

a back plate within said housing oriented parallel to said face plate in proximity to said opposite surface thereof, the space between said plates forming a gear area, an hour gear having a central axis;

a tubular hour shaft connecting the central axis of said hour gear to said hour hand through said opening in said face plate, a minute gear, and a minute gear pinion axially affixed to said minute gear, said minute gear and said minute gear pinion having a common concentric axis;

a tubular minute shaft rotatable within said hour shaft and connecting the common concentric axis of said minute gear and pinion, concentrically with respect to said hour shaft, to said minute hand through said opening in said face plate;

a toothed second wheel, and a second wheel pinion axially affixed to said second wheel, said second wheel and said second wheel pinion having a common concentric axis;

a second shaft rotatable within said minute shaft and connecting the common concentric axis of said second wheel and pinion, concentrically with respect to said hour shaft and said minute shaft, to said second hand through said opening in said face plate;

wherein said central axis of said hour gear, said common concentric axis of said minute gear and pinion, and said common concentric axis of said second wheel and pinion are a single common axis;

a motion gear is meshing engagement with said minute gear pinion, and a motion gear pinion axially affixed to said motion gear with said motion gear pinion in meshing engagement with said hour gear, said motion gear and said motion gear pinion having a common concentric axis;

a motion gear shaft connecting said motion gear and pinion to said housing to be rotatable therewithin so that said motion gear shaft is rotatable about an axis which is parallel to and located outbound from said single axis;

an intermediate gear in meshing engagement with said second wheel pinion, and an intermediate gear pinion axially affixed to said intermediate gear with said intermediate gear pinion in meshing engagement with said minute gear, said intermediate gear and said intermediate gear pinion having a common concentric axis;

an intermediate gear shaft connecting said intermediate gear pinion to said housing to be rotatable therewithin so that said intermediate gear shaft is rotatable about an axis which is parallel to and located outbound from said single axis;

a ratchet wheel comprising a. said second wheel, b. a reciprocating lever, said lever having an armature coupled thereto, d. a pawl for communicating motion to said second wheel, and c. a pawl for preventing back motion of said wheel; and a solenoid coupled to said pulsing means for receiving electrical pulses therefrom, and, when energized by one of said pulses, for attracting said armature, whereby all gears in said clock, except for said intermediate gear and said motion gear and their associated pinions, are aligned along said single common axis and wherein said hour gear is located in said gear area, said motion gear and said motion gear pinion are located in said gear area, said motion gear shaft is coupled to said back plate so as to be axially supported thereby while permitting rotation of said motion gear shaft about its axis, said minute gear and said minute gear pinion are located in said gear area, said intermediate gear pinion is located in said gear area, said intermediate gear is located in an area outside of said gear area, separated therefrom by said back plate, said intermediate gear shaft is connected to the axis of said intermediate gear at said outside area and is connected to the axis of said intermediate gear pinion at said gear area, said intermediate gear shaft being adapted to freely rotate about its axis within said back plate, and said second wheel pinion, said ratchet wheel, and said solenoid being located at said outside area.

2. The improvement as recited in claim 1 wherein *t* equals one second.

3. In an electrical clock mechanism, the improvement comprising:

an armature of low remanent, high permeable material adapted to be normally at rest at a first position, and adapted to be electromagnetically attracted to a second position;

means effective when said armature is at said second position, in the absence of electromagnetic attraction, for causing said armature to return to said first position;

solenoid means having a coil adapted to be coupled to receive an electrical signal;

a core within said coil;

first pole piece means having a portion thereof connected to one end of said core, and having a second portion thereof formed in a circular disc, and circular disc portion covering at least a portion of one end of said coil; and second pole piece means connected to the opposite end of said core, formed in an axial direction along the exterior of said solenoid, and extending past said first pole piece circular disc portion;

said first pole piece means and said second pole piece means being so formed so that when said coil is energized, a magnetic field is produced therebetween, and wherein said both pole piece means are so oriented so that said second position is located within said magnetic field, and wherein when said coil is energized, said armature is magnetically attracted to said second position, and stops at said second position in response to said magnetic field without said armature physically contacting either said solenoid means, said core, either of said pole piece means, or any portions thereof.

4. The electrical clock mechanism as recited in claim 3 wherein at least a portion of said second pole piece means which extends past said disc portion is bent inwardly toward said disc portion.

5. In an electrical clock mechanism, the improvement comprising:

a second hand;

a toothed second wheel a second shaft connecting the axis of said wheel to said second hand;

a ratchet wheel comprising a. said second wheel, b. a reciprocating lever, c. a pawl for communicating motion to said second wheel, and d. a pawl for preventing back motion of said wheel;

an armature of low remanent, high permeable material coupled to said reciprocating lever and adapted to be normally at rest at a first position and to be electromagnetically attracted to a second position;

means effective when said armature is at said second position, in the absence of electromagnetic attraction, for causing said armature to return to said first position;

solenoid means having a coil adapted to be coupled to receive an electrical signal;

a core within said coil;

first pole piece means having a portion thereof connected to one end of said core, and a second portion thereof formed in a circular disc, said circular disc portion covering at least a portion of one end of said core;

second core piece means connected to the opposite end of said core, formed in an axial direction along the exterior of said solenoid means, and extending past said first pole piece circular disc portion;

said first pole piece means and said second pole piece means being so formed so that, when said coil is energized, a magentic field is produced therebetween, and wherein said both pole piece means are so oriented so that said second position is located within said magnetic field, and wherein when said coil is energized, said armature is magnetically attracted to said second position, and stops at said second position in response to said magnetic field without said armature physically contacting either said solenoid means, said core, either of said pole piece means, or portions thereof.

6. The electrical clock mechanism of claim 5 wherein at least a portion of said second pole piece means which extends past said disc portion is bent inwardly toward said disc portion.

7. In an electrical clock mechanism including a housing; a second hand; a second wheel having a plurality of teeth oriented about its periphery with each tooth having a face portion oriented in a generally radial direction with respect to said wheel, and having an inclined ramp portion connecting the face portion of one tooth to the face portion of an adjacent tooth; a second shaft connecting the axis of said wheel to said second hand; a ratchet wheel having said second wheel, a reciprocating lever adapted to reciprocate from one position to another, pawl means for communicating motion to said second wheel, and a pawl for preventing back motion of said wheel; and means for reciprocating said lever, the improvement wherein said pawl means comprises a music wire having one end thereof affixed to said reciprocating lever, and having an end portion near the opposite end thereof adapted to engage the teeth of said wheel; and support means affixed to said lever for supporting a substantial portion of said music wire when said music wire drives said wheel in a tooth face engaging manner, and for not supporting said substantial portion of said music wire when said music wire retracts a tooth distance and said music wire end portion traverses said inclined ramp portion.

8. The improvement as recited in claim 7 wherein said support means is essentially a cylindrical mass of material affixed to said lever with one quadrant thereof removed at a substantive portion thereof away from said lever.

9. In an electrical clock mechanism including a housing; a second hand; a second wheel having a plurality of teeth oriented about its periphery with each tooth having a face portion oriented in a generally radial direction with respect to said wheel, and having an inclined ramp portion connecting the face portion of one tooth to the face portion of an adjacent tooth; a second shaft connecting the axis of said wheel to said second hand; ratchet wheel having said second wheel, a reciprocating lever adapted to reciprocate from one position to another, pawl means for communicating motion to said second wheel, and a pawl for preventing back motion of said wheel; and means for reciprocating said lever, the improvement wherein said pawl means comprises a flexible music wire having one end thereof affixed to said reciprocating lever, and having an end portion near the opposite end thereof adapted to engage the teeth of said wheel; and means for reducing the flexibility of said wire when said music wire drives said wheel in a tooth face engaging manner, and for permitting full flexibility of said wire when said wire retracts a tooth distance and said music wire end portion traverses said inclined ramp portion.

10. In an electrical clock mechanism including a housing; a second hand; a second wheel having a plurality of teeth oriented about its periphery with each tooth having a face portion oriented in a generally radial direction with respect to said wheel, and having an inclined ramp portion connecting the face portion of one tooth to the face portion of an adjacent tooth; a second shaft connecting the axis of said wheel to said second hand; a ratchet wheel having said second wheel, a reciprocating lever adapted to reciprocate from one position to another, pawl means for communicating motion to said second wheel, and a pawl for preventing back motion of said wheel; and means for reciprocating said lever, the improvement wherein said pawl means comprises a music wire having one end thereof affixed to said reciprocating lever, and having an end portion near the opposite end thereof adapted to engage the teeth of said wheel; and means for reducing the effective length of said wire when said music wire drives said wheel in a tooth face engaging manner, and for increasing the effective length of said wire when said music wire retracts a tooth distance and said music wire end portion traverses said inclined ramp portion.

11. In an electrical clock mechanism including a housing; a second hand; a second wheel having a plurality of teeth oriented about its periphery with each tooth having a face portion oriented in a generally radial direction with respect to said wheel, and having an inclined ramp portion connecting the face portion of one tooth to the face portion of an adjacent tooth; a second shaft connecting the axis of said wheel to said second hand; a ratchet wheel having said second wheel, a reciprocating lever adapted to reciprocate from one position to another, pawl means for communicating motion to said second wheel, and a pawl for preventing back motion of said wheel; and means for reciprocating said lever, the improvement wherein said means for reciprocating said lever comprises a dog affixed to said housing;

flat spring means having one end thereof affixed to said lever and having the opposite end free of attachment, said opposite end of said spring means being adapted to be biased against said dog and slide with respect thereto, said opposite end of said spring means being unbiased and disengaged from said dog when said lever is at said one position;

an armature carried by said lever; and a solenoid affixed to said housing, and adapted, when energized, to attract said armature so that said lever is reciprocated to said another position, whereby said spring means opposite end engages said dog and is biased thereby.

12. In an electrical clock having a housing; a face plate within said housing, said face plate having an analog dial face normally viewable at one surface thereof and having an opening therein from said one surface to an opposite surface thereof; hour, minute, and second hands which rotate about a common concentric axis; and pulsing means for converting direct current to a series of electrical pulses having a repetition rate t; the improvement comprising:

a back plate within said housing oriented parallel to said face plate in proximity to said opposite surface thereof, the space between said plates forming a gear area, an hour gear having a central axis;

a tubular hour shaft connecting the central axis of said hour gear to said hour hand through said opening in said face plate;

a minute gear, and a minute gear pinion axially affixed to said minute gear, said minute gear and said minute gear pinion having a common concentric axis;

a tubular minute shaft rotatable within said hour shaft and connecting the common concentric axis of said minute gear and pinion, concentrically with respect to said hour shaft, to said minute hand through said opening in said face plate;

a toothed second wheel and a second wheel pinion, said second wheel and said second wheel pinion having a common concentric axis;

a second shaft rotatable within said minute shaft and connecting the common concentric axis of said second wheel and said second wheel pinion, concentrically with respect to said hour shaft and said minute shaft, to said second hand through said opening in said face plate;

wherein said central axis of said hour gear, said common concentric axis of said minute gear and pinion, and said common concentric axis of said second wheel and pinion are a single common axis;

a motion gear in meshing engagement with said minute gear pinion, and a motion gear pinion axially affixed to said motion gear with said motion gear pinion in meshing engagement with said hour gear, said motion gear and said motion gear pinion having a common concentric axis;

a motion gear shaft connecting said motion gear and pinion to said housing to be rotatable therewithin so that said motion gear shaft is rotatable about an axis which is parallel to and located outbound from said single axis;

an intermediate gear in meshing engagement with said second wheel pinion, and an intermediate gear pinion axially affixed to said intermediate gear with said intermediate gear pinion in meshing engagement with said minute gear, and intermediate gear and said intermediate gear pinion having a common concentric axis;

an intermediate gear shaft connecting said intermediate gear and pinion to said housing to be rotatable therewithin so that said intermediate gear shaft is rotatable about an axis which is parallel to and located outbound from said single axis;

a ratchet wheel comprising a. said second wheel, b. a reciprocating lever, said lever having an armature coupled thereto, c. pawl means for communicating motion to said second wheel, and d. pawl means for preventing back motion of said wheel;

and a solenoid coupled to said pusling means for receiving electrical pulses therefrom, and, when energized by one of said pulses, for attracting said armature, whereby all gears in said clock, except for said intermediate gear and said motion gear and their associated pinions, are aligned along said single common axis, and wherein said hour gear is located in said gear area, said motion gear and said motion gear pinion are located in said gear area, said motion gear shaft is coupled to said back plate so as to be axially supported thereby while permitting rotation of said motion gear shaft about its axis, said minute gear and said minute gear pinion are located in said gear area, said intermediate gear and intermediate gear pinion are located in said gear area, said intermediate gear shaft is coupled to said back plate so as to be axially supported thereby while permitting rotation of said intermediate shaft about its axis, and said ratchet wheel and said solenoid are located in an area outside of said gear area, separated therefrom by said back plate.

13. The improvement as recited in claim 12 wherein t equals one second.

14. In an electrical clock mechanism including a main housing; a second hand; a second wheel rotatable about a first axis having a plurality of teeth oriented about its periphery with each tooth having a face portion oriented in a generally radial direction with respect to said wheel, and having an inclined ramp portion connecting the face portion of one tooth to the face portion of an adjacent tooth; a second shaft connecting said axis of said wheel to said second hand; a ratchet wheel having said second wheel, a reciprocating lever adapted to reciprocate from one position to another, first pawl means for communicating motion to said second wheel, and second pawl means for preventing back motion of said wheel, and means for reciprocating said lever, the improvement wherein said first pawl means comprises an inwardly radially directed, toward said first axis, spring receiving housing formed with respect to said reciprocating lever;

a spring having a first end housed within said spring receiving housing, and having a second end;

a pawl member having a tooth portion, a spring engaging portion coupled to said second end, and a pivot axis parallel to said first axis; and means coupled to said reciprocating lever and said pawl member pivot axis so that said pawl member is pivotable thereabout, and said tooth portion is engageable with a tooth on said second wheel, wherein said spring is so biased to urge said pawl member tooth portion toward said first axis to engage a tooth on said second wheel.

15. In an electrical clock mechanism including a main housing; a second hand; a second wheel rotatable about a first axis having a plurality of teeth oriented about its periphery with each tooth having a face portion oriented in a generally radial direction with respect to said wheel, and having an inclined ramp portion connecting the face portion of one tooth to the face portion of an adjacent tooth; a second shaft connecting said axis of said wheel to said second hand; a ratchet wheel having said second wheel, a reciprocating lever adapted to reciprocate from one position to another, first pawl means for communicating motion to said second wheel, and second pawl means for preventing back motion of said wheel; and means for reciprocating said lever, the improvement wherein said second pawl means comprises a support member coupled to said main housing;

an inwardly radially directed, toward said first axis, spring receiving housing formed with respect to said support member;

a spring having a first end housed within said spring receiving housing, and having a second end;

a pawl member having a tooth portion, a spring engaging portion coupled to said second end, and a pivot axis parallel to said first axis; and means coupled to said support member and said pawl member pivot axis so that said pawl member is pivotable thereabout, and said tooth portion is engageable with a tooth on said second wheel, wherein said spring is so biased to urge said pawl member tooth portion toward said first axis to engage a tooth on said second wheel.

16. In an electrical clock mechanism including a main housing; a second hand; a second wheel rotatable about a first axis having a plurality of teeth oriented about its periphry with each tooth having a face portion oriented in a generally radial direction with respect to said wheel, and having an inclined ramp portion connecting the face portion of one tooth to the face portion of an adjacent tooth; a second shaft connecting said axis of said wheel to said second hand; a ratchet wheel having said second wheel, a reciprocating lever adapted to reciprocate from one position to another, first pawl means for communicating motion to said second wheel, and second pawl means for preventing back motion of said wheel; and means for reciprocating said lever, the improvement wherein aid first pawl means comprises a first inwardly radially directed, toward said first axis, spring receiving housing formed with respect to said reciprocating lever;

a first spring having a first end housed within said first spring receiving housing, and having a second end;

a first pawl member having a tooth portion, a spring engaging portion coupled to said second end, and a pivot axis parallel to said first axis; and means coupled to said reciprocating lever and said first pawl member pivot axis so that said first pawl member is pivotable thereabout, and said first tooth portion is engageable with a tooth on said second wheel, wherein said first spring is so biased to urge said first pawl member tooth portion toward said first axis to engage a tooth on said second wheel; and wherein said second pawl means comprises a support member coupled to said main housing;

a second inwardly radially directed, toward said first axis, spring receiving housing formed with respect to said support member;

a second spring having a first end housed within said second spring receiving housing, and having a second end;

a second pawl member having a tooth portion, a spring engaging portion coupled to said second end of said second spring, and a pivot axis parallel to said first axis; and means coupled to said support member and said second pawl member pivot axis so that said second pawl member is pivotable thereabout, and said second tooth portion is engageable with a tooth on said second wheel, wherein said second spring is so biased to urge said second pawl member tooth portion toward said first axis to engage a tooth on said second wheel; wherein said first pawl is adapted to engage a tooth on said second wheel for communicating motion to said wheel, and said second pawl is adapted to engage a tooth on said second wheel for preventing back motion of said wheel.

17. In an automobile clock mechanism including a housing, the improvement comprising a vertically disposed planar support member within said housing, said member having a shaft receiving hole therethrough, said member dividing said housing into two regions: a gear region, and a ratchet wheel region;

a horizontally disposed second shaft rotatable within said shaft receiving hole for communicating intermittent rotary motion from said ratchet wheel region to said gear region, for directly driving a second hand and for indirectly driving a minute hand and an hour hand;

a ratchet wheel within said ratchet wheel region including a. a toothed second wheel oriented distal to and parallel with said member and having its central axis affixed to said second shaft, one side of said wheel proximal to said member having a truncated portion extending therefrom, b. a reciprocating lever of self lubricating plastic pivotable with respect to said shaft disposed between said member and said wheel, said lever having a flat surface proximal to said second wheel and having a pair of rounded protuberances integrally formed therein proximal to said member, c. pawl means coupled to said lever for communicating motion to said wheel, and d. pawl means coupled to said member for preventing backward motion of said wheel; and means for reciprocating said lever, wherein 1. as said lever reciprocates, said rounded protuberances act as bearing surfaces against said member, and 2. as said clock mechanism vibrates, said truncated portion of said wheel limits axial motion of said lever.

18. In an electrical automobile clock having a housing; a face plate within said housing, said face plate having an analog dial face normally viewable at one suface thereof and having an opening therein from said one surface to an opposite surface thereof; hour, minute, and second hands which rotate about a common concentric axis; and pulsing means for converting direct current to a series of electrical pulses having a repetition rate *t;* the improvement comprising an hour gear having a central axis;

an hour shaft connecting the central axis of said hour gear, via said opening in said face plate, to said hour hand;

a minute gear, and a minute gear pinion axially affixed to said minute gear, said minute gear and said minute gear pinion having a common concentric axis;

a minute shaft connecting the common concentric axis of said minute gear and pinion, concentrically with respect to said hour shaft, through said opening in said face plate, to said minute hand;

a toothed second wheel and a second wheel pinion, said second wheel and said second wheel pinion having a common concentric axis;

a second shaft connecting the common concentric axis of said second wheel and said second wheel pinion, concentrically with respect to said hour shaft and said minute shaft, through said opening in said face plate, to said second hand, wherein said central axis of said hour gear, said common concentric axis of said minute gear and pinion, said common concentric axis of said minute gear and pinion, and said common concentric axis of said second wheel and pinion are a single common axis;

a motion gear in meshing engagement with said minute gear pinion, and a motion gear pinion axially affixed to said motion gear with said motion gear pinion in meshing engagement with said hour gear, said motion gear and said motion gear pinion having a common concentric axis;

a motion gear shaft connecting said motion gear and pinion to said housing to be rotatable therewithin so that said motion gear shaft is rotatable about an axis which is parallel to and located outbound from said single axis;

an intermediate gear in meshing engagement with said second wheel pinion, and an intermediate gear pinion axially affixed to said intermediate gear with said intermediate gear pinion in meshing engagement with said minute gear, said intermediate gear and said intermediate gear pinion having a common concentric axis;

an intermedate gear shaft connecting said intermediate gear and pinion to said housing to be rotatable therewithin so that said intermediate gear shaft is rotatable about an axis which is parallel to and located outbound from said single axis;

a ratchet wheel comprising a. said second wheel, b. a reciprocating lever pivotable about said common axis, said lever having an armature coupled thereto at said common axis, c. pawl means for communicating motion to said second wheel, and d. pawl means for preventing back motion of said wheel;

and a rotary solenoid coupled to said pulsing means for receiving electrical pulses therefrom, and, when energized by one of said pulses, for rotatably attracting said armature, whereby all gears in said clock, except for said intermediate gear and said motion gear and their associated pinions, are aligned along said single common axis.

19. In an electrical clock mechanism including a housing; hour, minute and second wheels within said housing; means responsive to said minute wheel for intermittently advancing said hour wheel once each hour; and means responsive to said second wheel for intermittently advancing said minute wheel once each minute; each of said wheels being rotatable about a common axis; a ratchet wheel including a toothed wheel rotatable about said common axis and affixed to said second wheel, a reciprocating lever having an armature coupled thereto and being pivotable about said common axis, and pawl means for communicating forward motion to and for preventing backward motion of said ratchet wheel; the improvement comprising:

solenoid means for receiving electrical pulses and for attracting said armature when energized, and including a coil, a core within said coil; first pole means having a first portion connected to one end of said core and a second portion formed in a substantially circular disc covering at least a portion of one end of said coil; and a second pole means connected to the opposite end of said core and extending axially along the exterior of said solenoid means past said disc portion of said first pole means;

said first and second pole means being oriented to create a magnetic field therebetween, upon energizing of said coil, sufficient to attract said armature to a second position and then stop the movement of said armature before it contacts said solenoisd means or any portions thereof.

20. In the electrical clock mechanism of claim 19, the further improvement comprising said pawl means including:

a music wire having one end thereof affixed to said reciprocating lever, and having an end portion near the opposite end thereof adapted to engage the teeth of said ratchet wheel; and means for reducing the effective length of said wire as said music wire drives said wheel in a tooth face engaging manner, and for increasing the effective length of said wire as said music wire retracts a tooth distance and said music wire end portion traverses said inclined ramp portion.

21. In the electrical clock mechanism of claim 19, the further improvement comprising means for reciprocating said lever including:

dog means affixed to said housing; and flat spring means having one end thereof affixed to said lever and an opposite end free of attachment, said opposite end of said spring means being adapted to be biased against said dog means and slidable with respect thereto, said opposite end of said spring means being unbiased and disengaged from said dog means when said lever is at one position, and engaged against and biased by said dog means as said lever is reciprocated to a second position.

22. In the electrical clock mechanism of claim 19, the further improvement comprising first pawl means for communicating forward motion to said ratchet wheel and second pawl means for preventing backward motion of said wheel, said first pawl means including:

an inwardly radially directed spring receiving housing formed with respect to said reciprocating lever;

a spring having a first end housed within said spring receiving housing, and having a second end outside said housing;

a pawl member having a toth portion, a spring engaging portion coupled to said second end; and means coupled to said reciprocatng lever and said pawl member pivot axis so that said pawl member is pivotable thereabout, and said tooth portion is engageable with a tooth on said wheel, wherein said spring is so biased to urge said pawl member tooth portion toward said first axis to engage a tooth on said ratchet wheel.

23. In the electrical clock mechanism of claim 22, the further improvement comprising said second pawl means including:

a support member coupled to said main housing;

an inwardly radially directed spring receiving housing formed with respect to said support member;

a spring having a first end housed within said spring receiving housing, and having a second end outside said housing;

a pawl member having a tooth portion, a spring engaging portion coupled to said second end; and means coupled to said support member and said pawl member pivot axis so that said pawl member is pivotable thereabout, and said tooth portion is engageable with a tooth on said ratchet wheel, wherein said spring is so biased to urge said pawl member tooth portion toward said first axis to engage a tooth on said ratchet wheel.

24. In a digital electrical clock mechanism including:

a. a housing;

b. an hour drum within said housing;

c. a minute drum within said housing;

d. means responsive to said minute drum for intermittently driving said housing drum once each hour;

e. a second drum within said housing;

said drums each being rotatable about a common axis;

f. means responsive to said second drum for intermittently driving said minute drum once each minute;

g. a ratchet wheel including 1. a toothed wheel, rotatable about said common axis, directly affixed to said second drum,
2. a reciprocating lever, pivotable about said common axis, said lever having an armature coupled thereto,
3. a pawl for communicating motion to said wheel, and
4. a pawl for preventing back motion of said wheel;

the improvement comprising:

solenoid means for receiving electrical pulses and for attracting said armature when energized, and including a coil, a core within said coil; first pole means having a first portion connected to one end of said core and a second portion formed in a substantially circular disc covering at least a portion of one end of said coil; and a second pole means connected to the opposite end of said core and extending axially along the exterior of said solenoid means past said disc portion of said first pole means;

said first and second pole means being oriented to create a magnetic field therebetween, upon energizing of said coil, sufficient to attract said armature to a second position and then stop the movement of said armature before it contacts said solenoid means or any portions thereof.

* * * * *